US006971521B2

(12) United States Patent
Pinyot

(10) Patent No.: US 6,971,521 B2
(45) Date of Patent: Dec. 6, 2005

(54) PACKAGING SYSTEM FOR MULTIPLE DISCRETE FOODSTUFFS

(76) Inventor: Jeffrey S. Pinyot, 12524 Kelly Pl., Fishers, IN (US) 46038

( * ) Notice: Subject to any disclaimer, the term of this patent is extended or adjusted under 35 U.S.C. 154(b) by 287 days.

(21) Appl. No.: 10/374,937

(22) Filed: Feb. 25, 2003

(65) Prior Publication Data

US 2004/0163986 A1 Aug. 26, 2004

(51) Int. Cl.[7] ..... B65D 21/00
(52) U.S. Cl. ..... 206/503; 206/216
(58) Field of Search ..... 206/139, 216, 206/427, 428, 430, 431, 432, 503, 504, 508, 206/509

(56) References Cited

U.S. PATENT DOCUMENTS

| | | | | | |
|---|---|---|---|---|---|
| 2,753,077 | A | | 7/1956 | Greco | |
| 3,009,569 | A | * | 11/1961 | Blais | 206/503 |
| 3,143,205 | A | * | 8/1964 | Ruderian | 206/543 |
| 3,250,564 | A | * | 5/1966 | Stern | 294/87.2 |
| 3,348,716 | A | * | 10/1967 | Nakata | 215/6 |
| 3,369,691 | A | * | 2/1968 | Wei | 220/4.27 |
| 3,384,259 | A | * | 5/1968 | Hoffstadt | 220/4.27 |
| 3,458,078 | A | | 7/1969 | Skidmore | |
| 4,563,186 | A | | 1/1986 | Flynn et al. | |
| 4,930,636 | A | * | 6/1990 | Meadows | 206/503 |
| 4,938,374 | A | | 7/1990 | Wuchterl | |
| 4,940,137 | A | | 7/1990 | Straub | |
| 5,154,295 | A | | 10/1992 | Stoner | |
| 5,178,276 | A | * | 1/1993 | Sheets | 206/427 |
| 5,279,841 | A | * | 1/1994 | Yu | 426/131 |
| 5,335,813 | A | | 8/1994 | Qi | |
| 5,339,975 | A | | 8/1994 | Stoner | |
| D350,460 | S | | 9/1994 | Picozza et al. | |
| 5,385,326 | A | | 1/1995 | Bidwell | |
| 5,398,827 | A | | 3/1995 | Armstrong et al. | |
| 5,409,128 | A | | 4/1995 | Mitchell | |
| 5,425,196 | A | * | 6/1995 | Schwarze | 43/54.1 |
| 5,445,287 | A | | 8/1995 | Center et al. | |
| 5,535,908 | A | * | 7/1996 | Sheu | 220/4.27 |
| 5,573,133 | A | * | 11/1996 | Park | 220/4.27 |
| 5,613,620 | A | | 3/1997 | Center et al. | |
| 5,657,871 | A | * | 8/1997 | Waters et al. | 206/509 |
| 5,722,540 | A | * | 3/1998 | Laird et al. | 206/503 |
| 5,740,914 | A | | 4/1998 | Herzog | |
| 5,743,423 | A | * | 4/1998 | Franco | 220/23.86 |
| 5,826,712 | A | * | 10/1998 | Aikio | 206/203 |
| 5,887,740 | A | * | 3/1999 | Hong | 220/4.27 |
| 5,927,499 | A | * | 7/1999 | Vesborg | 206/509 |
| 5,992,677 | A | | 11/1999 | Ebine | |
| 6,021,913 | A | * | 2/2000 | McGrath | 220/513 |
| D424,932 | S | | 5/2000 | Seidler | |
| D426,150 | S | | 6/2000 | Izumi et al. | |
| D439,835 | S | | 4/2001 | Boldt | |

* cited by examiner

*Primary Examiner*—Kurt Fernstrom
(74) *Attorney, Agent, or Firm*—Woodard, Emhardt, Moriarty, McNett & Henry LLP

(57) ABSTRACT

A packaging system for multiple discrete foodstuffs includes a first container having a first opening, a removable element closing the first opening and a first outer shape and first dimension; a second container having a second opening, a removable element closing the second opening and a second outer shape and second dimension, the first container being stacked atop the second container; and, a binder at least partially encircling and removably securely holding the first and second containers together to form a multi-container combination with a main outer shape and main dimension substantially identical to the first and second outer shapes and dimensions.

27 Claims, 4 Drawing Sheets

PACKAGING SYSTEM FOR MULTIPLE DISCRETE FOODSTUFFS

FIELD OF THE INVENTION

The present invention relates to the field of packaging for foods and beverages, and more particularly to a method and apparatus for packaging multiple discrete food and/or beverage items.

BACKGROUND OF THE INVENTION

Manufacturers of foodstuffs are constantly in search of new ways to present, package and market their products. In the highly competitive world of food sales, the smallest innovation, oddity or improvement can translate into millions in sales. Consumers can become familiar and tired of products they have consumed for a long time. New products can easily catch their attention and lure them away from the old standby. Similarly, new packaging can transform a seemingly back of the shelf, forgotten product to a consumer favorite.

From the consumer standpoint, people are always receptive to products that make life easier or save money. Even minor enhancements to a product's flavor, ease of opening, use and storage, shelf life and/or cost can be greatly rewarded by consumers with their patronage and ensuing loyalty.

In the foodstuff industry, waste is a major issue with consumers. This is especially true to parents of children who open a beverage, take two drinks, and waste the rest. Such children also open snack packages and leave them open to get stale or spill. And children (and some adults) are notorious for failing to share a drink.

SUMMARY OF THE INVENTION

Generally speaking, there is a packaging system for multiple discrete foodstuffs that combines two separate and distinct containers into one multi-container combination that closely resembles a standard foodstuff container and that can be vended from a standard vending facility such as a refrigerated 12 oz. can vending machine.

A packaging system for multiple discrete foodstuffs includes a first container having a first opening, a removable element closing the first opening and a first outer shape and first dimension; a second container having a second opening, a removable element closing the second opening and a second outer shape and second dimension, the first container being stacked atop the second container; and, a binder at least partially encircling and removably securely holding the first and second containers together to form a multi-container combination with a main outer shape and main dimension substantially identical to the first and second outer shapes and dimensions.

DESCRIPTION OF THE PREFERRED EMBODIMENT

Figure 3:
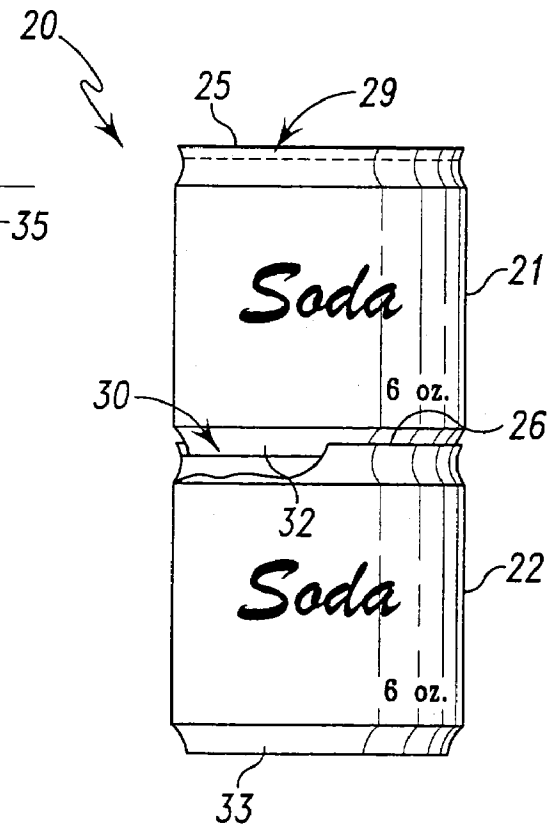
FIG. 3 is an elevational view of the packaging system 20 of FIG. 2 shown without binder 24 and shown with a portion broken away for description.

For the purposes of promoting an understanding of the principles of the invention, reference will now be made to the embodiments illustrated in the drawings and specific language will be used to describe the same. It will nevertheless be understood that no limitation of the scope of the invention is thereby intended, and any alterations or modifications in the illustrated device, and any further applications of the principles of the invention as illustrated therein are contemplated as would normally occur to one skilled in the art to which the invention relates.

Figure 1:
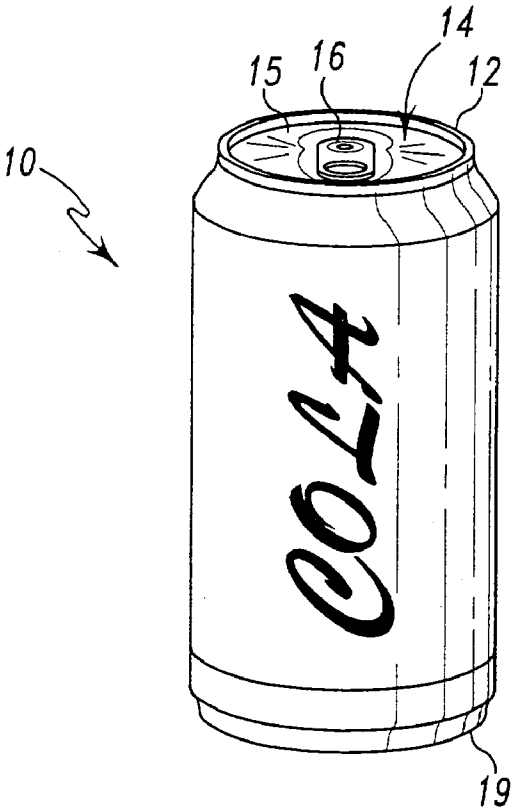
FIG. 1 is a perspective view of a standard 12 oz. beverage can 10.

Referring to FIG. 1 there is shown a standard 12 oz. beverage can 10 of the type that would typically be held within and dispensed from a common refrigerated vending machine. Standard can 10 has a height of about 4.8 inches and has a main cylindrical body having a diameter of about 2.5 inches. At the top of can 10, an annular rim 12 is defined with a diameter that is slightly less than the diameter of the main body. Within rim 12 is defined a recess 14, the bottom of which is defined by the top surface 15 of can 10, the top surface 15 including a standard pull tab 16 for opening the can. At the bottom of can 10, the diameter is reduced to form a nesting cup 19 that is sized and shaped to be matingly received within recess 14 of another can. Thus, one can 10 can be stacked atop another such can so that the nesting cup 19 at the bottom of the top can nests within the complementary sized and shaped recess 14 of the bottom can, and the top can is somewhat stabilized against lateral movement with respect to the bottom can. Moreover, six such cans bound together in a known fashion to form a six-pack can be stacked atop another such six-pack, and the upper six-pack is held laterally in a relatively stable position with respect to the bottom six-pack.

Figure 2:
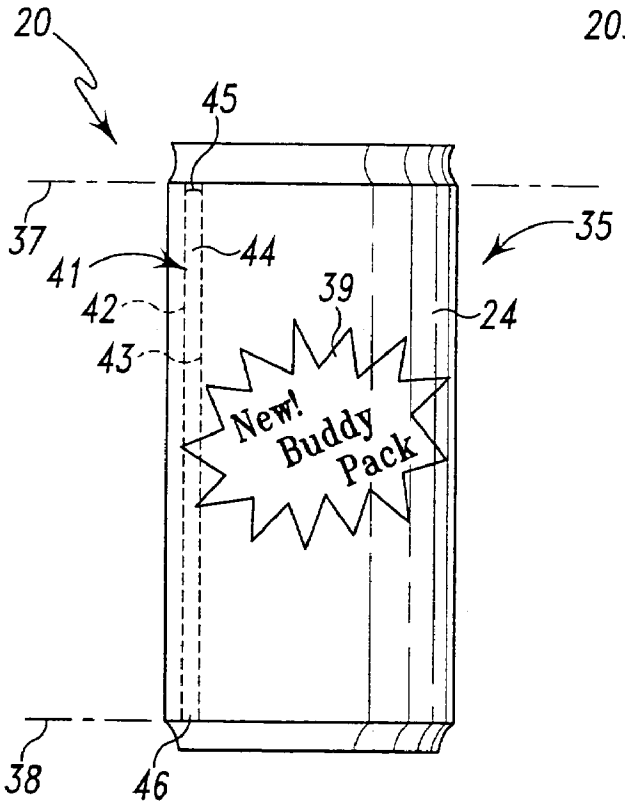
FIG. 2 is an elevational view of a packaging system 20 for multiple discrete foodstuffs in accordance with one embodiment of the present invention.

Referring now to FIGS. 2 and 3, there is shown a packaging system 20 for multiple discrete foodstuffs in accordance with one embodiment of the present invention. Packaging system 20 generally includes a first, upper container 21, a discrete second, lower container 22 and a binder 24. Upper and lower containers 21 and 22 are beverage cans, each having the identical outer shape and dimension as standard 12 oz. beverage can 10, the difference being that each container 21 and 22 is shorter than standard can 10. Containers 21 and 22 are generally cylindrical and, thus, the dimension of each can is its diameter. Like beverage can 10, containers 21 and 22 include upper rims 25 and 26, respectively, recesses 29 and 30 defined therein, respectively, and nesting cups 32 and 33, respectively. The shapes and configurations of containers 21 and 22 are such that when one is stacked atop the other, as shown in FIG. 2, the total stacked height is generally equal to the height of a standard can 10, and the generally uniform diameter of the two containers 21 and 22 is generally equal to or just slightly less than the diameter of a standard can 10. Although two cans will have some additional material (at the bottom of top can 21 and the top of bottom can 22), it is contemplated that manufacturing tolerances will permit each can to be able to contain 6.0 fluid ounces so that the two cans together hold the same fluid volume as a whole can 10.

As shown in FIG. 2, a binder 24 is applied around (encircles) stacked containers 21 and 22 to tightly bind them together in such stacked condition. The resulting multi-can combination 35, comprising bound, multiple discrete containers, now bears substantially the same outward appearance as a standard 12 oz. beverage can 10. Binder 24 is a rectangular sheet of plastic that wraps tightly around the generally cylindrical shape of stacked containers 21 and 22 and is bound to itself along a strip where the sheet contacts or overlaps itself. Binder 24 is sized to extend along substantially the entire height of the cylindrical portion of the can (i.e. roughly between horizontal planes 37 and 38). Alternatively, binder 24 may comprise a plastic tube into which is positioned the pair of cans 21 and 22. The plastic is then treated by known methods (such as by heating) to cause it to tightly shrink and to bind cans 21 and 22 together. While each can 21 and 22 will bear its own indicia (indicating contents, volume, nutrition, etc.), the rectangular sheet, tube or other material that forms binder 24 will bear any desirable artwork and/or other indicia 39 indicating, among other things, that the package holds multiple discrete containers. It is contemplated that binder 24 comprise any material deemed sufficiently strong to hold two or more containers together, as described herein. It is deemed preferable to have such material be receptive to printing, to be lightweight, and to add as little diameter as possible to the combined product (i.e. the thickness of the binder material). It is also desired that such material be of sufficient strength to withstand the forces endured in the act of vending and handling in traditional ways.

It is desired that the overall size of the multi-can combination 35 be identical or substantially identical to that of a standard can 10 so the multi-can combination 35 can be received, stored and vended from a standard vending machine. Thus, if the thickness of the binding material 24 used to bind cans 21 and 22 together is too thick to permit the vending machine to properly vend the multi-can combination 35, the diameter of cans 21 and 22 can be reduced accordingly so that the resulting multi-can combination 35 will be properly received, held and vended from such vending machine. Other materials for binder 24 are contemplated, such as, paper, Tyvek, nylon, netting and other appropriate materials both now in existence and to be developed in the future, so long as such material can hold cans 21 and 22 together into an otherwise unitary item. It is further contemplated that binder 24 be made to be discarded or to be used as a coupon, as a points accumulator for winning or purchasing valuables, as an instant win couipon (with information printed on the obverse side), or for any other advertising, information or product promotion desired. For example, binder 24 may be used for various marketing programs such as: on airlines where an airline logo is printed thereon and a combination beverage and snack (as described herein) are served on flights; in connection with sports teams where the combination product is sold in stores and sports venues; with company incentive programs with the company logo printed thereon; with movie merchandising; with music titles; etc. Binder 24 completely encircles (that is, it essentially forms a tube around) multi-can combination 35, but other configurations are contemplated wherein only portions of binder 24 encircle multi-can combination 35. Binder 24 may be configured to encircle containers 21 and 22, not in horizontal encirclement (as shown in FIG. 2), but in other directions such as vertical or diagonal encirclement, or some combination thereof (not shown), so long as containers 21 and 22 are bound together in the general shape and dimension of one of the standard beverage containers. Such "standard" generally refers to the 12 oz., 14 oz., 16 oz., 20 oz., etc., but other sizes are contemplated.

Binder 24 includes a means for breaking the bind and separating cans 21 and 22. Such means includes a slight vertical scoring or perforation 41, made large enough for the consumer to easily find and to pull, thereby making removal of the rest of binder 24 fairly simple. In one embodiment, perforation 37 includes two parallel, linear perforation lines 42 and 43 running the entire height of binder 24, between planes 37 and 38, thus creating a perforation pull strip 44. Beginning at the top 45 (or bottom 46) of pull strip 44, the user can peel strip 44 vertically to break and remove binder 24, and to thus free cans 21 and 22 from each other. Alternatively, the consumer could open the top can 21 and consume its contents without breaking binder 24, and could delay breaking binder 24 until she is ready to open the bottom can 22. Alternative embodiments are contemplated where the peel strip runs around the multi-can combination 35 other than strictly vertically. For example, the peel strip could run at an angle to form a spiral, which would permit easy removal of binder 24. Alternatively, the peel strip could run circumferentially, in a ring around multi-can combination 35, close to or at the junction of cans 21 and 22. Pulling the strip off would at least allow the cans to be separated, though it might not cause the binder to simple fall away as it would with a vertical or spiral peel strip. Embodiments are contemplated wherein a pull strip is formed or configured in any other appropriate manner to enable binder 24 to be removed. For example, a pull strip is contemplated to be formed, not by perforations, but by a strip (not shown) mounted underneath binder 24. Pulling such strip fractures or splits the binder proximal such strip. Such designs are commonly known with respect to cigarette packs and decks of playing cards.

The sizes of containers 21 and 22 may be identical (i.e. 6 oz. each) or they may vary. Thus, in the embodiment of FIGS. 2 and 3, each container is 6 oz. and stacked and bound as shown. The combined, multi-can combination 35 is now sized substantially identically to a standard 12 oz. can 10 and can be stored in and vended from a beverage vending machine. Multi-can combination 35 is contemplated to contain two or more containers, the containers carrying any combination of liquid or solid foodstuffs. For example, containers 21 and 22 could contain two separate beverages (regular cola and diet cola; grape soda and orange soda; club soda and tonic water). Alternatively, both cans could contain the same beverage so that there are two discrete servings—one for each of two children or one for now the other for later. Other combinations include alcoholic mixes where one can would contain the alcohol or alcohol blend and the other the mix. In this configuration, the cans would be sized to contain the two beverages in their proportionate volumes (i.e. 3 oz. in one can and 9 oz. in the other). This would thus permit the drink to be mixed fresh by the consumer at the time of opening the cans rather than vending a fully mixed beverage in a single can.

Figure 10:
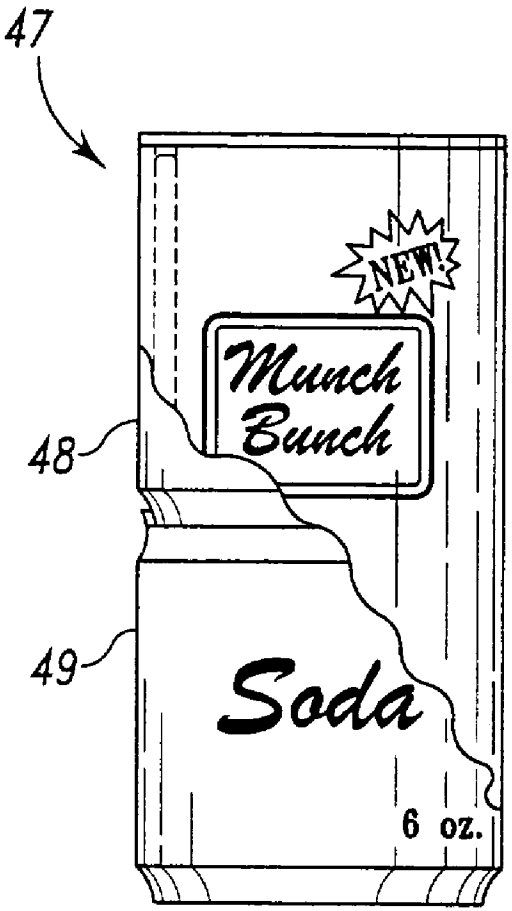
FIG. 10 is an elevational view of a packaging system 47 for multiple discrete foodstuffs in accordance with another embodiment of the present invention and with a portion of the binder removed.

Alternatively, containers 21 and 22 could contain a non-beverage foodstuff and a beverage (see e.g. the packaging system 47 of FIG. 10 with pretzels in one container 48 and a soft drink in the other container 49 for a complete snack), or two complete non-beverage foodstuffs (e.g. complementary snacks such as crackers in one container, cheese in the other not shown). As used herein, foodstuffs are considered to be either a beverage or a non-beverage. Where a container carries a non-beverage foodstuff, the container is contemplated to have a slightly different configuration. For example, instead of a pull tab 16, a non-beverage foodstuff container would have a tamper-resistant foil lid with a pull-back tab (not shown) as is well known in the industry (such as on many peanut cans), or any other suitable easily openable lid or access port. Other configurations contemplating non-beverage foodstuff containers are provided elsewhere herein.

Figure 5:
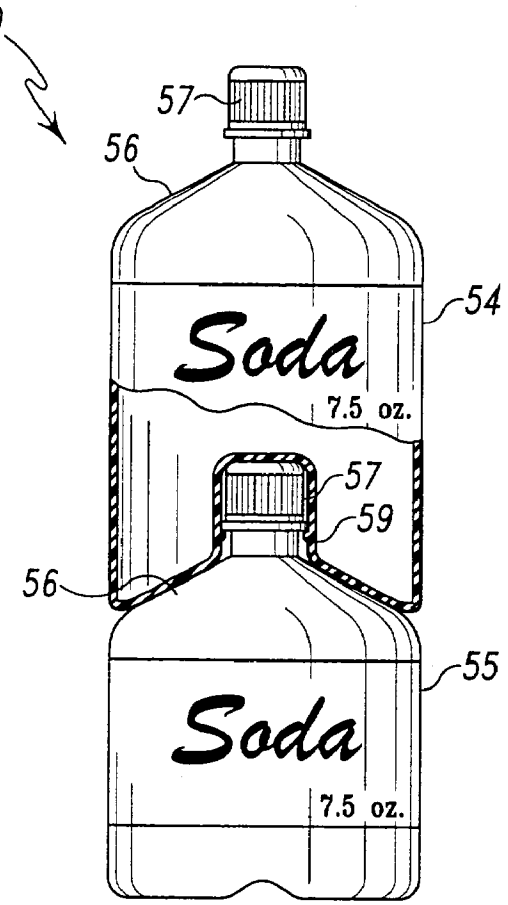
FIG. 5 is a partially cross-sectional, elevational view of the packaging system 50 of FIG. 4 and shown without the binder 60.
Figure 4:
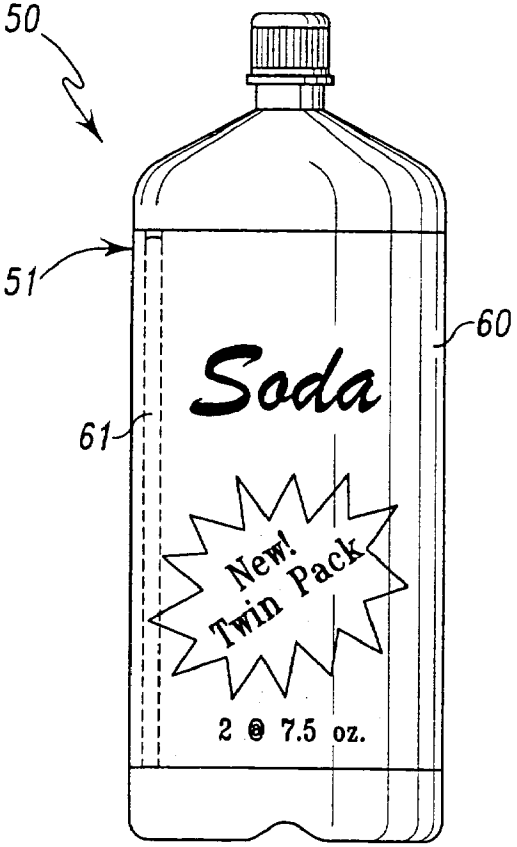
FIG. 4 is an elevational view of a packaging system 50 for multiple discrete foodstuffs in accordance with another embodiment of the present invention.

Referring to FIGS. 4–5, there is shown a packaging system 50 for multiple discrete foodstuffs in accordance with another embodiment of the present invention. Instead of the multi-can combination 35 of system 20, system 50 includes a multi-bottle combination 51 that is configured in size and shape to resemble a standard plastic beverage bottle (e.g. a standard 16 oz. or 20 oz. cola bottle) and to be able to be received, stored and vended from a vending machine that is set up to vend such plastic beverage bottles. Multi-bottle combination 51 includes identical bottles 54 and 55. Each bottle has an upper portion 56 and a screw-cap 57 (or other openable lid structure) at its top and is configured with a recess 59 in its bottom. Recess 59 is sized and shaped to receive the bottle cap 57 and some part of upper portion 56 of another bottle 55 therein, as shown in FIG. 5. A binder 60 is applied around bottles 54 and 55 to tightly, but removably bind bottles 54 and 55 together. Like binder 24 of multi-can combination 35, binder 60 is provided with means for breaking the bind between the bottles, such as a perforation pull strip 61, which is pulled vertically from either its top or bottom to break binder 60 and allow bottles 54 and 55 to be separated. In the embodiment of FIGS. 4 and 5, once binder 60 is broken, bottles 54 and 55 may simply be pulled apart.

Alternative embodiments are contemplated wherein the cap 57 and recess 59 of each bottle are configured so that, when the cap 57 and upper portion 56 of a bottle 55 are inserted into the recess 59 of another bottle 54, the upper bottle 54 would securely latch onto the cap 57 of the lower bottle 55. Such configuration would resemble many medication bottles wherein positioning the cap atop a mating, open bottle and applying downward pressure thereto causes the cap to snap to a closed position covering the bottle. In the present invention, when binder 60 is broken, instead of simply pulling bottles 54 and 55 apart, the lower bottle 55 is opened by twisting bottle 55 relative to upper bottle 54 (which is gripping the cap 57 of lower bottle 55 within its recess 59). The configuration of the recess 59 is contemplated to grip the cap 57 of the lower bottle and to require only that the two bottles be twisted relative to each other to open lower bottle 55. Alternative embodiments are contemplated wherein, like the child-safety configuration on some pill medication, an axial, compressive force must be applied simultaneously with a counterclockwise twisting force to remove the upper bottle 54 (and the cap 57 of the lower bottle 55) from lower bottle 55. The cap 57 would remain lodged within recess 59 of the upper bottle 54. Such configuration would prevent accidental opening of lower bottle 55 while drinking from upper bottle 54. Such cap and bottle configurations are well known.

Figure 6:
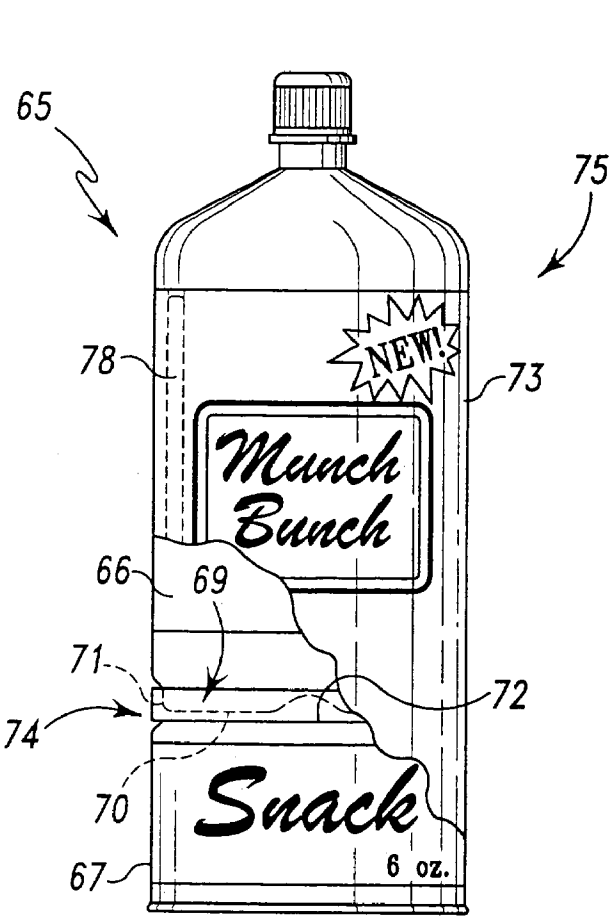
FIG. 6 is an elevational view of a packaging system 65 for multiple discrete foodstuffs in accordance with another embodiment of the present invention and with a portion of binder 73 removed.

Referring to FIG. 6, there is shown a packaging system 65 for multiple discrete foodstuffs in accordance with another embodiment of the present invention. Like packaging system 50 of FIGS. 4–5, packaging system 65 includes a pair of containers, here an upper beverage bottle 66 and a foodstuff can 67. Can 67 is contemplated to be similar to known sealed cans holding snacks such as nuts, pretzels or potato chips and, like the soda cans of packaging system 20, can 67 defines a recess 69 at its top that is sized to receive therein the complementary-shaped bottom 70 of beverage bottle 66. Can 67 can be opened through a peel-away tab (not shown, but located generally at 72 at the bottom of recess 69) or via some other suitable opening mechanism. Like the multi-can combination 35 of FIG. 2–3, the diameter at the bottom 70 of bottle 66 is reduced to form a nesting cup 71 that nests within recess 69, and a suitable binder 73 is applied to securely bind bottle 66 and can 67 together for vending in a machine suitable for beverage bottles of the same size. The outer surfaces of bottle 66 and can 67 are configured for substantial vertical alignment so that, upon application of the plastic or other suitable binder 73, the junction 74 of bottle 66 and can 67 is substantially imperceptible, and the outer profile of the resulting multi-container combination 75 closely or substantially identically resembles that of a standard beverage bottle. That is, the profile of such configuration does not readily reveal that the multi-container combination 75 comprises two discrete containers holding two discrete foodstuffs. Like binder 24 of multi-can combination 35, binder 73 is provided with means for breaking the bind between the bottles, such as a perforation pull strip 78, which is pulled vertically from either its top of bottom to break binder 73 and allow bottles 66 and 67 to be separated. In the embodiment of FIG. 6, once binder 73 is broken, bottles 66 and 67 may simply be pulled apart.

Figures 7, 8, 9:
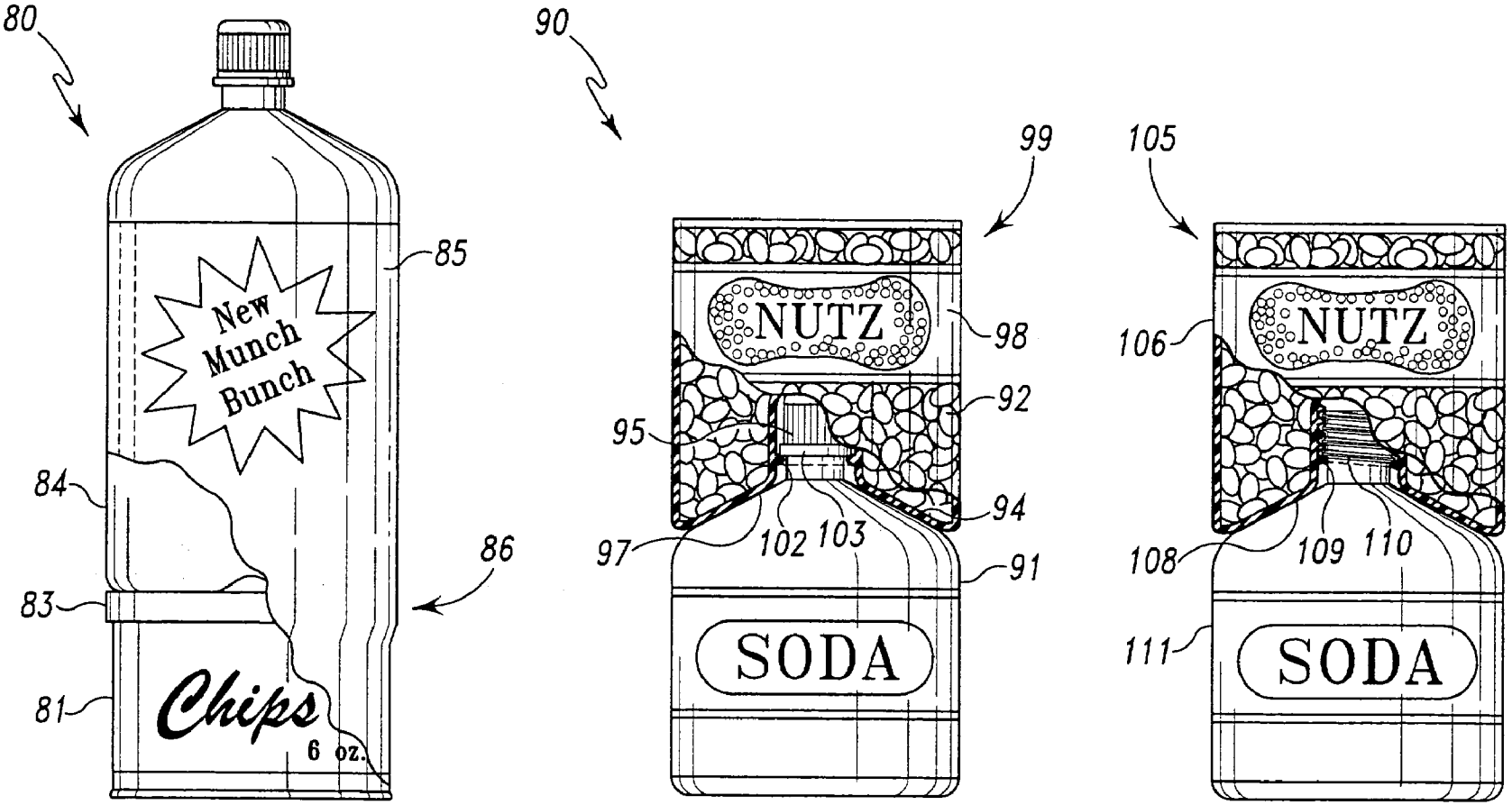
FIG. 7 is an elevational view of a packaging system 80 for multiple discrete foodstuffs in accordance with another embodiment of the present invention and with a portion of binder 85 removed.
FIG. 8 is an elevational view of a packaging system 90 for multiple discrete foodstuffs in accordance with another embodiment of the present invention and with a portion of binder 98 removed.
FIG. 9 is an elevational view of a packaging system 105 for multiple discrete foodstuffs in accordance with another embodiment of the present invention and with a portion of the binder removed.

Referring to FIG. 7, there is shown a packaging system 80 for multiple discrete foodstuffs in accordance with another embodiment of the present invention. Packaging system 80 is like packaging system 65 of FIG. 6, except that the non-beverage container or can 81 has a replaceable lid 83 that fits over the top of the can body. Such configuration is typical, for example, of a Pringles® potato chip can. A binder 85 applied to tightly bind together can 81 and the beverage bottle 84 here slightly reveals the junction 86 between can 81 and bottle 84. This is acceptable so long as it does not inhibit reliable vending from a vending machine configured to vend standard bottles of a similar, but substantially perfectly cylindrical shape.

Referring to FIG. 8, there is shown a packaging system 90 for multiple discrete foodstuffs in accordance with another embodiment of the present invention. Packaging system 90 is similar to packaging systems 20 of FIGS. 2 and 3 and 50 of FIGS. 4 and 5. Packaging system 90 comprises a lower beverage bottle 91 and an upper container 92 configured for non-beverage foodstuffs such as nuts. Lower container 91 is shaped like a standard beverage bottle, although shorter. Bottle 91 is similar to bottle 55 of FIG. 5 and includes an upper portion 94 and a cap 95. Upper container 92 has a generally cylindrical portion, and like bottle 54 of FIG. 5, defines a recess 97 that is sized and shaped to receive bottle cap 95 and some part of upper portion 94 of the bottle 91 therein, as shown in FIG. 8. The top of upper container 92 is flattened and sized so that when upper portion 94 and cap 95 of bottle 91 are inserted into recess 97, and a suitable binder 98 is applied to securely bind containers 91 and 92 together, the resulting multi-container combination 99 is sufficiently similar to a standard soda can 10 to enable it to be vended from a standard soda can vending machine. Upper container 92 also provides a flange 102 that extends inwardly into recess 97. Flange 102 is sized and configured to engage with an outwardly extending ledge 103 of cap 95 upon assembly. Flange 102 may or may not form a continuous ring within recess 97 but its inner dimension (i.e. inner radius) is less than the outer dimension (radius) of ledge 103 such that, when bottle 91 and its cap 95 are forced up into recess 97, the larger dimensioned ledge 103 engages with flange 102 and, upon application of additional axial compressive force, ledge 103 snaps past flange 102 and locks above it as shown in FIG. 8. Bottle 91 may be removed from container 92 (absent binder 98) by simply pulling it from container 92, the ledge 103 snapping past flange 102. Alternatively, structure (not shown) is formed to extend inwardly from upper container 92 into recess 97, and/or structure (not shown) extends outwardly from cap 95, to lock cap 95 against axial rotation relative to upper container 92 once cap 95 has been snapped into place above ledge 102 (not shown). In such configuration, bottle 91 is removed from upper container 92 by twisting it, the cap 95 being held firmly by container 92. Alternative configurations are contemplated wherein such protrusions are appropriately ramped to permit cap 95 to rotate in only one direction relative to upper container 92. Configurations are also contemplated wherein cap 95 is frangibly connected with container 92. That is, bottle 91 is screwed into cap 95, and removal of container 92 from bottle 91 may be accomplished by unscrewing one relative to the other, but a frangible connection (not shown) between bottle 91 and either cap 95 or container 92 must first be overcome and broken by applying a slightly greater twisting torque. Such connections are common in the bottled beverage industry.

Referring to FIG. 9, there is shown a packaging system 105 for multiple discrete foodstuffs in accordance with another embodiment of the present invention. Packaging system 105 is like packaging system 90 of FIG. 8, except that the non-beverage container 106 defines a recess 108 wherein one or more threads 109 are defined therein to engage with the threaded spout 110 of lower bottle 111. In this configuration, the cap of lower bottle 111 is formed integrally in the bottom of upper container 106. Such integral cap formation is contemplated for use in any of the configurations presented herein, where feasible in view of the material and shape of the particular containers.

While the present invention has been described in terms of vending from a machine configured to vend cans and bottles of the same size and shape as the multi-can or multi-bottle combination, the invention contemplates other suitable vending locations where such standard single-foodstuff cans and bottles would be displayed and/or sold. Examples include, without limitation, refrigerated display cases with divided or channeled shelves, ice chests and standard grocery store shelves.

Alternative embodiments contemplate both containers containing non-beverage foodstuffs. For example, each of two containers are contemplated to hold a non-beverage foodstuff (e.g. pretzels in one, peanuts in the other) and to be bound together into a unitary-looking, but multi-container combination by a suitable binder, as described herein. Such multi-container combination is contemplated to resemble a standard unitary-looking package, such as a cola can or cola bottle, to present a novel multiple-product package and to permit a variety of standard available vending options, such as from a standard beverage vending machine. Similarly, alternative configurations are contemplated wherein one of two containers contains a foodstuff (beverage or non-beverage foodstuff), and the other contains a novelty, such as a toy. Such combination would hold significant appeal to children who, like digging through the cereal box for the included toy, may seek the multi-container combination product more for the novelty than for the foodstuff. Alternative embodiments are contemplated wherein there is a cavity defined between the top and bottom containers and a novelty is disposed in such cavity. The novelty may only be retrieved upon removal of the binder and separation of the containers. Examples of novelties that could be positioned in such cavity include: a round sports card, a round hero card (presidents, statesmen, explorers, etc.), a token, a game piece (i.e. fast-food restaurants often run prize contests centered around popular board games such as Monopoly®), a coupon, a golden coin to win a trip, points to earn merchandise, and a special View-Master® slide sporting the new era in collectible, interactive sports cards. Such cavity could be made to be large enough to hold larger toys, game pieces, and the like. The only limit to the size and shape of such cavity is the overall size and shape of the multi-container combination and the volume in each container available for foodstuff to be contained therein. Furthermore, the novelty need not be round or of the same shape as the cavity.

Alternative embodiments are contemplated wherein the multi-container combination includes more than two containers bound together to resemble a standard, unitary product container. For example, one multi-container combination is contemplated to contain a beverage bottle, a non-beverage foodstuff can and a novelty container, all bound to resemble a standard 12 oz. can or 16 oz. bottle. Configurations containing more than two containers are contemplated to be more easily assembled, to provide more desirable portion sizes and to be more cost efficient where the similar, unitary-container to be resembled is one of a larger size. For example, combining three containers together to resemble a 20 oz. bottle is believed to be easier to accomplish, to provide three, more desirable-sized portions and to provide the consumer a better value for the money than if the multi-container combination is made to resemble a 12 oz. bottle. In this regard, a multi-container combination containing two or more containers bound together to resemble a standard two litre bottle is also contemplated.

While the invention has been illustrated and described in detail in the drawings and foregoing description, the same is to be considered as illustrated and not restrictive in character, it being understood that all changes and modifications that come within the spirit of the invention are desired to be protected. The articles "a", "an", "said" and "the" are not intended to be limited to a singular element, and include one or more such element. Examples that are provided herein are intended to be representative of but some of the possible alternative configurations of the invention and are not intended to be in any way limiting of the invention.

What is claimed is:

1. A packaging system for multiple discrete foodstuffs, comprising:

a first container having a first opening, a removable element closing said first opening, a first height and a first outer shape and first outer dimension;

a second container having a second opening, a removable element closing said second opening, a second height and a second outer shape and second outer dimension, said first container being stacked atop said second container;

a binder at least partially encircling and removeably securely holding said first and second containers together to form a multi-container combination with a main outer shape and main outer dimension; and, wherein said first and second containers are sized and configured to define a cavity therebetween when said first container is staked atop and bound to said second container and said packaging system further includes a novelty positioned in said cavity.

2. The packaging system for multiple discrete foodstuffs of claim 1 wherein the first outer shape is generally identical to the second outer shape.

3. The packaging system for multiple discrete foodstuffs of claim 1 wherein the first outer dimension is generally identical to the second outer dimension.

4. The packaging system for multiple discrete foodstuffs of claim 3 wherein the first outer shape is generally identical to the second outer shape.

5. The packaging system for multiple discrete foodstuffs of claim 1 wherein the first outer shape is cylindrical.

6. The packaging system for multiple discrete foodstuffs of claim 1 wherein the first outer shape is rectangular.

7. The packaging system for multiple discrete foodstuffs of claim 1 wherein the removable element closing said second opening is connected to said first container.

8. A packaging system for multiple discrete foodstuffs comprising:

a first container having a first opening, a removable element closing said first opening, a first height and a first outer shave and first outer dimension;

a second container having a second opening, a removable element closing said second opening, a second height and a second outer shape and second outer dimension, said first container being stacked atop said second container, and wherein the removable element closing said second opening is integrally formed with said first container; and, a binder at least partially encircling and removeably securily holding said first and second container together to form a multi-container combination with a main outer shape and main outer dimension.

9. The packaging system for multiple discrete foodstuffs of claim 1 wherein the said first container is frangibly connected with said second container.

10. The packaging system for multiple discrete foodstuffs of claim 1 wherein at least one of said first and second containers is a can.

11. The packaging system for multiple discrete foodstuffs of claim 10 wherein both said first and second containers are cans.

12. The packaging system for multiple discrete foodstuffs of claim 10 wherein at least one of said first and second containers is a bottle.

13. The packaging system for multiple discrete foodstuffs of claim 1 wherein at least one of said first and second containers is a bottle.

14. The packaging system for multiple discrete foodstuffs of claim 13 wherein both of said first and second container are bottle.

15. Thc packaging system for multiple discrete foodstuffs of claim 1 further including a third container having a third opening, a removable element closing said third opening, a third height and a third outer shape and third outer dimension, said first and second containers being stacked atop said third container, and wherein said binder at least partially encircles and removeably securely holds said first and second containers together to form the multi-container combination.

16. The packaging system for multiple discrete foodstuffs of claim 1 wherein at least one of said first and second containers holds a beverage.

17. The packaging system for multiple discrete foodstuffs of claim 16 wherein both of said first and second containers holds a beverage.

18. The packaging system for multiple discrete foodstuffs of claim 16 wherein at least one of said first and second containers holds a non-beverage foodstuff.

19. The packaging system for multiple discrete foodstuffs of claim 1 wherein at least one of said first and second containers holds a non-beverage foodstuff.

20. The packaging system for multiple discrete foodstuffs of claim 19 wherein both of said first and second containers hold a non-beverage foodstuff.

21. The packaging system for multiple discrete foodstuffs of claim 1 wherein said binder is made of plastic.

22. The packaging system for multiple discrete foodstuffs of claim 1 wherein said binder fully encircles said first and second containers together to form the multi-container combination.

23. The packaging system for multiple discrete foodstuffs of claim 22 wherein said binder includes a pull strip for breaking open said binder.

24. The packaging system for multiple discrete foodstuffs of claim 1 wherein the novelty is at least one of a sports card, a hero card, a token, a game piece, a coupon, a prize-redeemable voucher, a slip indicating points redeemable to earn merchandise, and a collectible slide.

25. The packaging system for multiple discrete foodstuffs of claim 1 wherein the novelty is a toy.

26. A packaging system for multiple discrete foodstuffs, comprising:

a first bottle having a bottom, a first opening, a first upper portion, a removable element closing said first opening, a first outer diameter and a threaded recess defined in the bottom;

a second bottle having a bottom, a threaded spout with a second opening, a second upper portion, and a second outer diameter;

wherein the spout of said second bottle is threadedly received in the recess of said first bottle;

a binder removeably securely holding said first and second bottles together to form a multi-bottle combination with a third outer diameter substantially identical to at least one of the first and second outer diameters.

27. A method for packaging multiple discrete foodstuffs, comprising the steps of:

providing a first container having a first opening and a removable element closing said first opening, a second container having a second opening and a removable element closing said second opening, and wherein said first and second containers are sized and configured to define a cavity therebetween when said first container is stacked atop and bound to said second container;

stacking said first container atop said second container with a novelty positioned in the cavity; and applying a binder at least partially encircling and removeably securely holding said first and second containers together to form a multi-containcr combination with the novelty contained in said cavity.

* * * * *